US007980176B2

(12) United States Patent
Bangel

(10) Patent No.: US 7,980,176 B2
(45) Date of Patent: Jul. 19, 2011

(54) PRINTING MACHINE

(75) Inventor: Dieter Bangel, Hüttenberg (DE)

(73) Assignee: Heidelberger Druckmaschinen, AG, Heidelberg (DE)

( * ) Notice: Subject to any disclaimer, the term of this patent is extended or adjusted under 35 U.S.C. 154(b) by 560 days.

(21) Appl. No.: 11/853,980

(22) Filed: Sep. 12, 2007

(65) Prior Publication Data

US 2008/0063458 A1 Mar. 13, 2008

(30) Foreign Application Priority Data

Sep. 13, 2006 (DE) ..... 10 2006 042 884

(51) Int. Cl.
*B41F 13/20* (2006.01)

(52) U.S. Cl. ..... 101/479; 101/480

(58) Field of Classification Search ..... 101/480, 101/479

See application file for complete search history.

(56) References Cited

U.S. PATENT DOCUMENTS

| | | | | |
|---|---|---|---|---|
| 5,784,958 | A | 7/1998 | Dylla et al. | |
| 7,111,552 | B2 * | 9/2006 | Kolbe et al. | 101/216 |
| 2004/0118309 | A1 * | 6/2004 | Fedor et al. | 101/480 |
| 2005/0119099 | A1 | 6/2005 | Madern | |
| 2006/0156934 | A1 | 7/2006 | Arabin et al. | |

FOREIGN PATENT DOCUMENTS

| | | | |
|---|---|---|---|
| DE | 3102116 | A1 | 9/1982 |
| DE | 9316412 | U1 | 1/1994 |
| DE | 9318226 | U1 | 1/1994 |
| DE | 4317684 | C2 | 12/1994 |
| DE | 9420690 | U1 | 2/1995 |
| DE | 19650812 | A1 | 6/1998 |
| DE | 10326669 | A1 | 1/2005 |
| EP | 0020886 | A1 | 1/1981 |
| EP | 0055669 | A1 | 7/1982 |
| EP | 0627307 | A1 | 12/1994 |
| EP | 0638419 | A1 | 2/1995 |
| EP | 0738590 | A1 | 10/1996 |
| EP | 1537920 | A1 | 6/2005 |
| GB | 2284250 | A | 5/1995 |
| WO | 2005028202 | A1 | 3/2005 |

* cited by examiner

*Primary Examiner* — Anthony H. Nguyen
(74) *Attorney, Agent, or Firm* — Laurence A. Greenberg; Werner H. Stemer; Ralph E. Locher

(57) ABSTRACT

A printing machine, in particular a label printing machine or a sheet-fed offset printing press, includes printing units accommodated in a machine support structure that is made at least partially, and preferably entirely, of rock. The rock may be a natural rock, in particular granite, or an artificial rock, in particular concrete.

22 Claims, 7 Drawing Sheets

PRINTING MACHINE

CROSS-REFERENCE TO RELATED APPLICATION

This application claims the priority, under 35 U.S.C. §119, of German Patent Application DE 10 2006 042 884.6, filed Sep. 13, 2006; the prior application is herewith incorporated by reference in its entirety.

BACKGROUND OF THE INVENTION

Field of the Invention

The invention relates to a printing machine, in particular for printing labels, including a machine support structure that includes a support element, and at least one printing unit at least part of which is accommodated in the support element through the use of a bearing element.

For many years, printing machines and individual components used in printing machines have been made of metallic materials, in particular of steels, aluminum, or titanium, on a large scale. Apart from the fact that those materials meet requirements in terms of some of their physical and technical characteristics, the fact that those materials have become widely used is, among other factors, clearly due to the easy availability of both qualitative skills and quantitative capacities in terms of the production and adequate processing of metallic materials. In printing machines that operate in accordance with the latest printing technology, the machine support structure usually is formed of large castings of metallic materials. In order to be molded into the desired shape, those castings require technically complex and frequently expensive processing. The use of metallic materials in modern printing technology generally requires auxiliary technical measures in order to counteract certain undesirable physical properties of those materials, such as electric conductivity, thermal expansion, mechanical vibration behavior, or consequences of those properties.

One of the largest and commercially most important sectors that use modern printing technology is the production of labels. International Application No. WO 2005/028202 A1, corresponding to U.S. application Ser. No. 11/384,632 and U.S. Patent Application Publication No. US 2006/0156934 A1, for example, discloses a label printing machine with individual drives for individual in-line printing units. In the printing machine, a web of printing material is processed to produce multicolor labels finished with special effects as desired. The printing processes employed in the label printing machine may vary in accordance with the print job so that different formats can be processed and different processes can be employed to meet a wide range of product requirements. For that purpose, the label printing machine has a number of disconnection points where printing units or printing unit parts that use different printing processes, in particular flexographic printing, gravure, offset printing, and screen printing, can be connected and disconnected. When a printing unit or a printing unit part is connected at a disconnection point, a drive connection to an individual drive for the printing unit or printing unit part is simultaneously established. The label printing machine described in International Application No. WO 2005/028202 A1, corresponding to U.S. application Ser. No. 11/384,632 and U.S. Patent Application Publication No. US 2006/0156934 A1, is manufactured in a conventional way from metallic castings.

SUMMARY OF THE INVENTION

It is accordingly an object of the invention to provide a printing machine, which overcomes the hereinafore-mentioned disadvantages of the heretofore-known devices of this general type, which is stable and which reduces or avoids negative consequences of undesirable properties of metallic materials.

With the foregoing and other objects in view there is provided, in accordance with the invention, a printing machine, in particular for printing and/or producing labels. The printing machine comprises a machine support structure with a support element at least partially made of rock, and at least one printing unit. A bearing element accommodates at least part of the at least one printing unit in the support element.

In connection with the invention, the term "rock" as it is used in the present description is understood to mean a solid mineral mass or a single object formed of a material of this type. In the context of the present description, the term "rock" as it is used herein is understood to be synonymous with the term "stone". The rock may be natural or artificial. Natural rock is a solid mineral mass created in the course of geology, part of the inorganic components of the earth's crust, or an individual object made of this material. Natural rock may be created by solidification of molten minerals (basalt, granite, volcanic rock) or by solidification of loose materials (sandstone, limestone). Artificial rocks are produced in technical processes.

The support element is made of rock, in particular of one rock or several rocks, preferably entirely of rock. Large parts of the machine support structure or the entire machine support structure, in particular, may be made of stone. It is preferred that the entire printing unit be received in the support element.

The bearing element may be connected to the support element so as to be releasable or non-releasable. The bearing element may, in particular, be a bushing or a hinge bearing or a pivot bearing or a grooved rail made of a metallic material. The bearing element may be fixed to the rock support element by adhesive bonding or screwing and may, in particular, be glued in or screwed in. The bearing element may also be an insert in the support element. The bearing element may be part of the printing unit or part of the machine support structure. If it is part of the printing unit, it may be a component of the printing unit, in particular a shaft, or a subassembly of the printing unit. The printing unit may be used to apply ink, varnish, clear varnish, or a substrate such as foil, a hologram, or a RFID circuit to a printing substrate. A printing unit may, in particular, include an inking unit and/or a dampening unit. Further parts of the printing press may be received in the support element directly, without a bearing element, or indirectly, through the use of a bearing element. For example, control components and/or drive components and/or processing devices such as dryers or cutting units, in particular, may be fixed to the support element. The support structure may also be referred to as a frame construction, a machine structure, or a support construction. The printing machine is preferably a rotary printing press.

The machine support structure, in particular the support element, is part of the printing press and not part of the surroundings in which the printing machine is placed. The support element is not to be considered as separate or independent of the printing press. In particular, the support element is not a support surface, a platform, a mounting element, a shop floor, a print shop foundation, a floor plate, or an intermediate platform for a printing machine. In other words, the printing unit or printing units are received in the support element rather than on the support element as part of a printing press.

The present invention advantageously provides a printing press that is inherently stable even under changing thermal conditions. The coefficient of expansion of rock is considerably lower than that of metals. The support element of the printing press according to the invention is inherently stable, also in terms of mechanical forces acting on the support element. In particular, it is more rigid or more stable than the metal materials that are commonly used. Moreover, rock has better vibration damping properties than the metal materials that are commonly used. Finally, rock is also an electric insulator, a fact which means that no corrosion occurs. Rock as a raw material can be processed with high precision, so that a very precise geometry of the support element and thus a support element of high quality, can be achieved.

The printing machine according to the invention even has commercial advantages because complex and expensive surface treatments for protective and/or aesthetic reasons, for example coatings or paint, are no longer required. Production costs for comparable components made of metal materials may actually be considerably higher than those for components made of rock, because processing, measuring, testing and assembling of components made of metal materials may be more complicated.

In accordance with another feature of the invention, the support element made of rock may provide a major part or all of the bearing forces required for positioning the at least one part of the printing unit in space and/or a compensation force for the gravitational force acting on the part of the printing unit. In other words, the support element is primarily used for mounting or fixing the printing unit of the printing machine according to the invention.

In accordance with a further feature of the invention, in some embodiments of the printing machine, a plurality of printing units may be received or accommodated in the support element. In addition or as an alternative, the machine support structure may include a plurality of support elements that are made of rock.

In accordance with an added feature of the invention, the support element or elements may be made of one piece, i.e. they may be a monoblock or monolith. The one piece (also referred to as a single piece) may be erected to be vertical, like a wall, in particular a side wall of a printing machine. In these embodiments, the one-piece rock is used to receive all printing units in an in-line configuration, in particular in the horizontal direction. In such an embodiment, table blocks and/or cross pieces may advantageously be dispensed with. This may save costs, in particular production costs, and simplify transportation. At the most, the one-piece rock may rest on separate feet, base profiles, or the like. It should be noted that the different expansion properties of metallic and mineral materials do not pose a problem in the one-piece construction because in the longitudinal direction, only mineral materials are provided, whereas the metallic components extend perpendicular to the one-piece rock. Due to the lack of metal connections in the longitudinal direction, undesirable length changes or expansions are avoided.

In accordance with an additional feature of the invention, the support element made of rock of the printing machine according to the invention may, in particular, be a base frame, a machine frame, a machine foundation, a base plate, a base unit, a printing unit frame, a printing unit support, a side part, a side wall, a side frame, a support frame, a portal support, or a connecting profile.

In accordance with yet another feature of the invention, in a first group of embodiments of the printing machine according to the invention, the rock is a natural rock. In other words, the support element may be made of a type of rock found in nature. This natural type of rock may, in particular, be an extrusive rock, an intrusive rock, a dike rock, an eruptive rock, or a metamorphic rock. The natural stone is preferred to be granite, granite-like, granite porphyry, gneiss, or marble. In particularly advantageous embodiments, the natural stone is black granite, gabbro, or impala granite.

The most preferred rock is impala granite: The expansion coefficient of impala granite is only approximately 0.2 of that of cast steel.

In accordance with yet a further feature of the invention, in a second group of embodiments of the printing machine according to the invention, the rock is an artificial rock. This artificial rock may, in particular, be concrete or a ceramic.

A particularly advantageous type of concrete has a tensile strength of more than 200 $N/cm^2$ and has a homogenous structure. The concrete may be armored concrete.

With reference to artificial rock, an embodiment in the shape of a single piece is preferred. Such an embodiment can be implemented in a simple and cost-effective way by using artificial rock.

In accordance with yet an added feature of the invention, in some embodiments, in particular of the first or second group, the support element may be a composite component or composite workpiece made of rock and at least one further material. In particular, the further material may be a plastic with a honeycomb structure. In this way, an advantageous reduction of the weight of the component may be attained while maintaining certain properties in terms of solidity and stability.

In accordance with yet an additional feature of the invention, in particular in an embodiment of the first group, the printing machine may be a web-processing printing machine, in particular for label printing. The web-processing printing machine may include a wind-up device for the printed web of printing material. The printing machine may be a narrow-web printing machine. The width of the web of material may be less than 550 mm, in particular less than 340 mm, even less than 285 mm.

In accordance with again another feature of the invention, in particular in an embodiment of the second group, the printing machine may alternatively be a sheet-processing printing machine. A sheet-processing printing machine may include a feeder, a number of printing units (typically 4, 6, 8, 10, or 12 printing units, in particular offset printing units), and a delivery. The sheet-processing printing machine may be a perfecting machine (reversing machine), i.e. a printing machine for printing both sides of a printing material in one pass.

In accordance with again a further feature of the invention, in a preferred embodiment, the printing machine is a label printing machine. The printing machine may be suitable for producing adhesive labels. The label printing machine may, in particular, include individual features and combinations of features as disclosed in International Application No. WO 2005/028202 A1, corresponding to U.S. application Ser. No. 11/384,632 and U.S. Patent Application Publication No. US 2006/0156934 A1. International Application No. WO 2005/028202 A1, U.S. application Ser. No. 11/384,632 and U.S. Patent Application Publication No. US 2006/0156934 A1, are explicitly incorporated by reference herein.

In accordance with again an added feature of the invention, the printing machine may be an offset printing press or may include at least one offset printing unit, possibly in combination with a number of other printing units operating in accordance with different printing processes (hybrid printing machine).

In accordance with again an additional feature of the invention, a preferred embodiment of the printing machine, in particular a label printing machine, includes a plurality of printing units (some or all of) which operate according to mutually different printing processes. The different printing processes may be one or more of the following printing processes: flexographic printing, gravure, letterpress printing, relief printing, direct or indirect planographic printing, lithographic printing, offset printing, waterless offset printing, coldfoil stamping, hotfoil stamping, ink jet printing, liquid toner printing, screen printing or xerography.

In accordance with still another feature of the invention, it is particularly advantageous if the printing machine, in particular a label printing machine, can be converted to different printing processes by removing a printing unit printing according to a first printing process partly or in total from the remainder of the printing machine at a disconnection point where, if necessary, the remaining part of the printing unit may also be removed, and by replacing it partly or in total by a printing unit to be received at the disconnection point and printing according to a second printing process.

In accordance with a concomitant feature of the invention, the printing machine according to the invention may include individual ones of the features given above or a combination of them. In addition or as an alternative to the features mentioned above, the printing machine according to the invention may include individual ones or combinations of the following features: the printing length and/or the printing width of the printing machine may be variable. The printing machine may include a modular structure for a plurality of printing units. Each of the plurality of printing units of the printing machine according to the invention may include a support structure with at least one support element made of rock. The printing units of the printing machine according to the invention may be disposed in line in a substantially horizontal direction. The printing units may be driven separately by individual drives.

Other features which are considered as characteristic for the invention are set forth in the appended claims.

Although the invention is illustrated and described herein as embodied in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
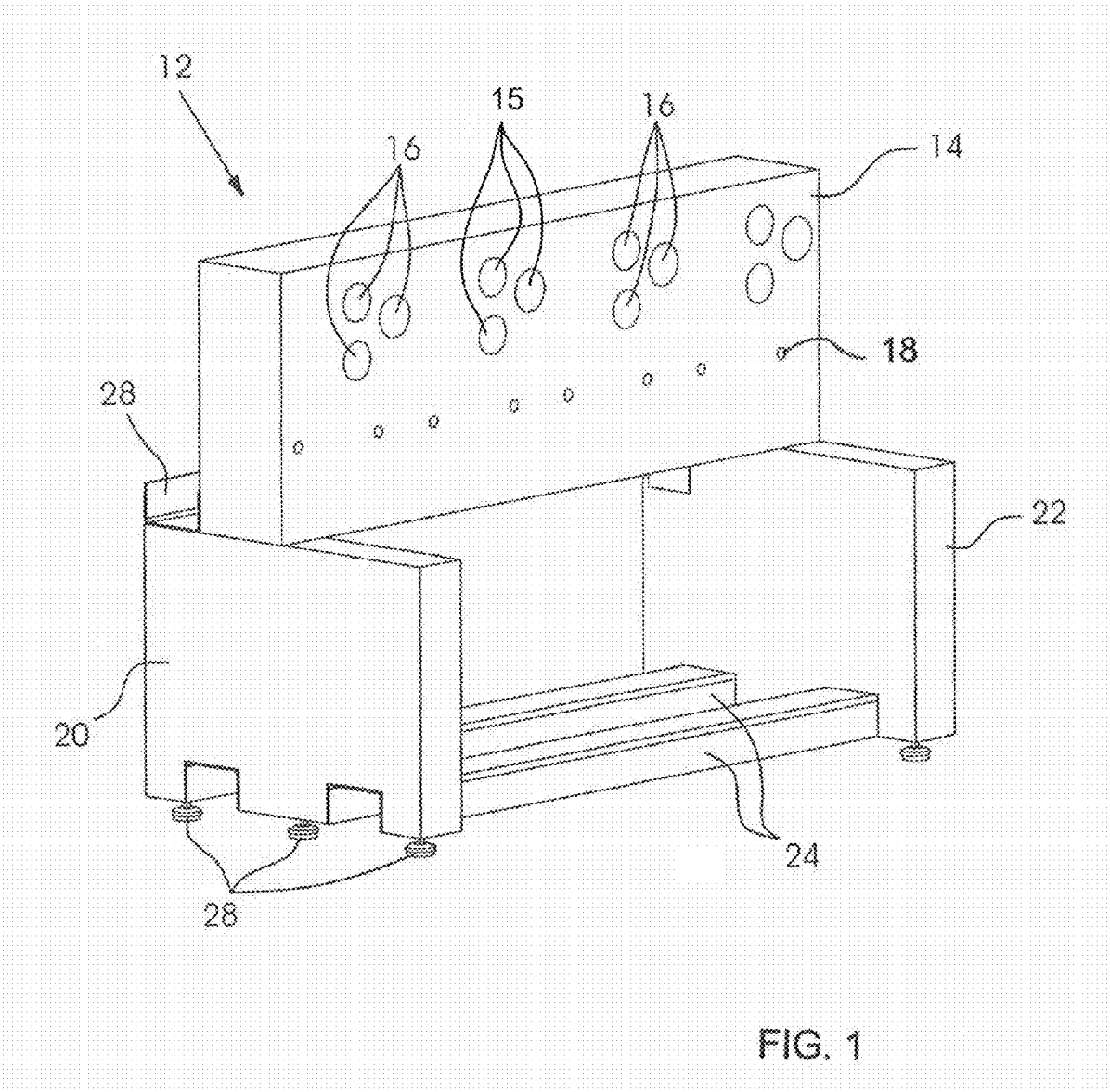
FIG. 1 is a diagrammatic, perspective view of a machine support structure formed of support elements made of rock in accordance with a preferred embodiment of a printing machine according to the invention.
Figure 5:
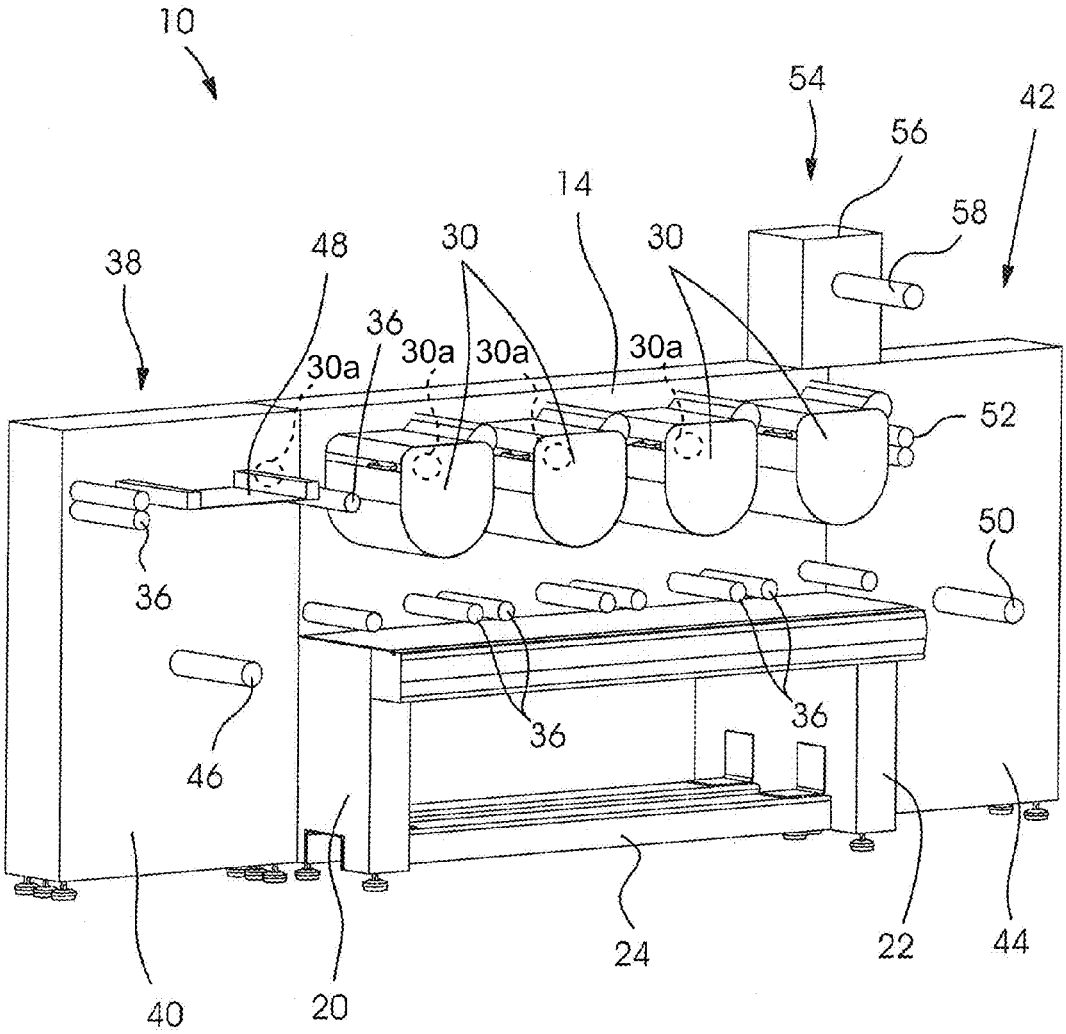
FIG. 5 is a perspective view illustrating a preferred embodiment of a printing machine according to the invention with a machine support structure as shown in FIG. 1.

Referring now to the figures of the drawings in detail and first, particularly, to FIG. 1 thereof, there is seen an operator-side view of a machine support structure 12 that is made of support elements formed of rock in accordance with a preferred embodiment of a printing machine 10 according to the invention. The printing machine 10 is shown in FIG. 5. This embodiment belongs to a first group of embodiments, which use natural stone. The machine support structure 12 includes a support element 14 made of rock and also referred to as a portal support. The support element 14 serves for receiving printing units (in the given example, there are four printing units for standard four-color printing) and other components, in particular web-guiding rollers. For this purpose, the support element 14 includes a number of shaft bores 16 disposed in groups for the individual printing units and roller bores 18. Printing units 30 shown in FIG. 5 are disposed in line in the horizontal direction. The support element 14 rests on a frame of the machine support structure 12. In this embodiment, a main component of this frame of the machine support structure 12 is likewise made of rock. The frame includes a left-hand side wall 20, a right-hand side wall 22 and two connecting profiles or profiled parts 24. In the preferred embodiment, the rock is impala granite. The machine support structure 12 rests on adjustable feet 26. In the view shown in FIG. 1, a cable duct 28 can be seen behind the support element 14. The cable duct 28 is a further connecting profile of the machine support structure 12.

Figure 2:
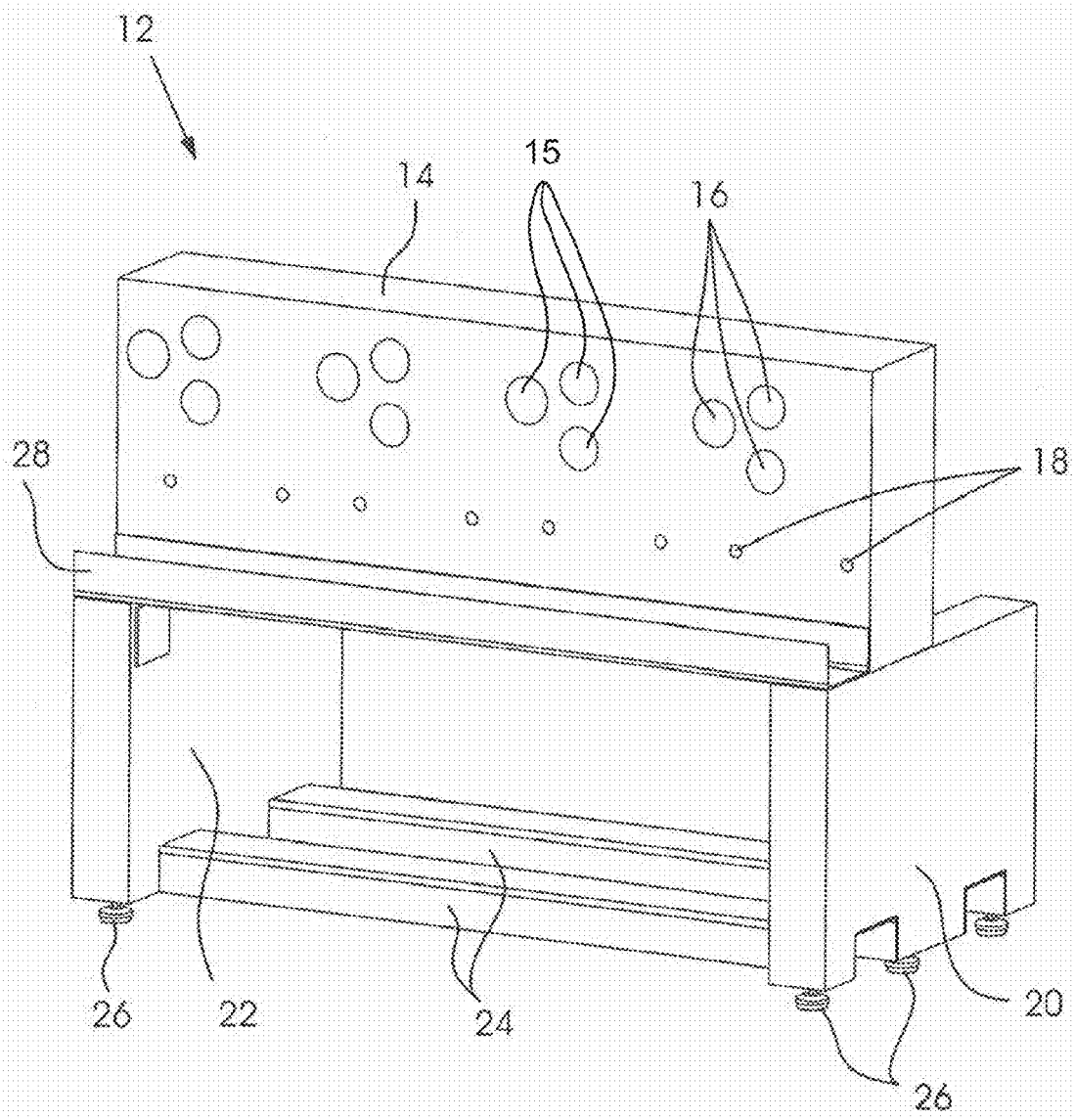
FIG. 2 is a perspective view illustrating a drive side of the embodiment shown in FIG. 1.

FIG. 2 is a view of the drive side of the embodiment of the machine support structure 12 shown in FIG. 1. On this side, separate drive units or individual drives 30*a* for each of the printing units 30 (refer to FIG. 5) are attached to the support element 14. Drive shafts of the printing units 30 pass through the shaft bores 16 in which they are received, through the use of bearing elements 15 (roller bearings in the present example) and are supported to be capable of rotating. Tools for the printing process according to which the printing unit operates, may be attached to each of the shaft journals. FIG. 2 also illustrates the left-hand side wall 20, the right-hand side wall 22, the connecting profiles 24, the adjustment feet 26 and the cable duct 28. The web-guiding rollers that are received in the roller bores 18 so as to be capable of rotating, are not driven.

Figure 3:
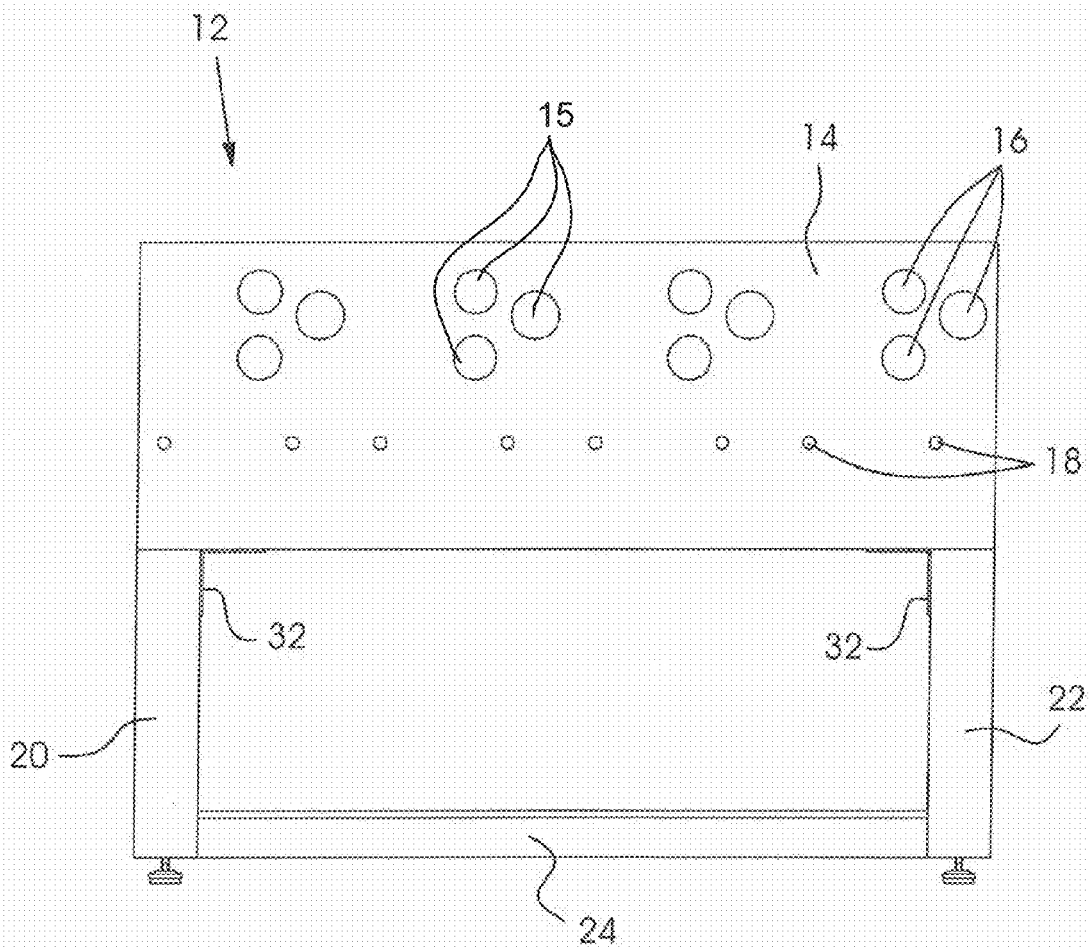
FIG. 3 is a front-elevational view of the embodiment shown in FIG. 1.

FIG. 3 shows a front view of the embodiment of the support structure 12 of the printing machine 10 according to the invention as shown in FIG. 1. The support element 14 with the shaft bores 16 and roller bores 18 is connected to the left-hand and right-hand side walls 20, 22 through the use of elbows 32. A stable frame for the machine support structure 12 is formed together with the connecting profiles 24.

Figure 4:
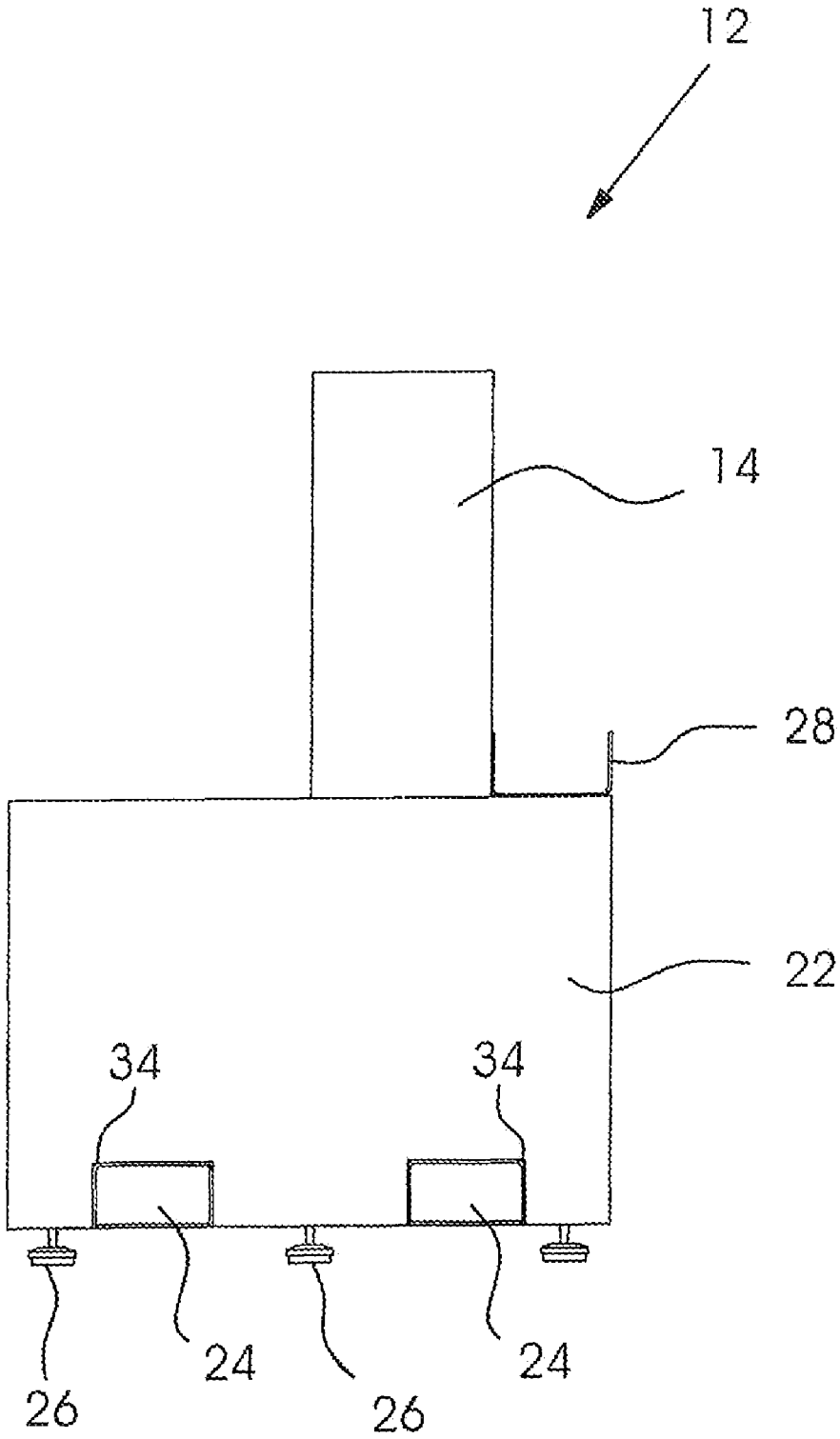
FIG. 4 is a side-elevational view of the embodiment shown in FIG. 1.

FIG. 4 shows a right-hand side view of the machine support structure 12 of the printing machine 10 according to the invention. The support element 14 and the right-hand side wall 22, which rests on adjustment feet 26 of the machine support structure 12, are visible. The connecting profiles 24 are received in recesses 34 of the right-hand side wall 22. The cable duct 28 has a U-shaped profile.

FIG. 5 shows a preferred embodiment of a printing machine 10 according to the invention, including a machine support structure 12 as shown in FIG. 1. In this embodiment, the printing machine is a web-processing printing machine, a label printing machine. The elements and components that are made of rock in a label printing machine are preferably made of natural rock, in particular granite. The machine support structure 12 with the component support element 14, left-hand side wall 20, right-hand side wall 22 and connecting profiles 24, which have already been described with reference to FIGS. 1 to 4, form a support for a processing part or printing part of the printing machine 10, in which a non-illustrated web of printing material (a substrate) is processed as it passes through the machine on its web path, guided by web-guiding rollers 36. The processing part includes four printing units 30 that are received on the support element 14. The printing units 30 of the embodiment shown in the figure can process varying formats, in particular it is possible to generate variable printing lengths by using cylinders of varying circumferential lengths. In addition, the printing units are convertible to different printing processes. In particular, it is possible to convert the printing units from flexographic printing to gravure and vice versa by simple remodeling of components of the printing units. Even screen printing is possible by simple conversion. It is also possible to replace an entire printing unit 30 by a diecutting unit or a stamping unit, in particular a hotfoil stamping unit. In this case, the diecutting unit or stamping unit is operated by a separate drive of the printing unit 30 that has been replaced, as has been described with reference to FIG. 2.

Upstream of the processing part, there is a machine inlet part 38, which includes a first support wall 40 made of rock. Downstream of the processing part, there is a machine outlet part 42, which includes a second support wall 44 made of rock. A substantial function of the machine inlet part 38 is to unwind a web of printing material that is to be printed and is located on a reel. For this purpose, an unwinding device 46 is provided. In addition, the machine inlet part 38 includes a discharge device 48. The machine outlet part 42 includes a wind-up device 50 for winding up the processed (in particular printed) web of printing material onto a reel. In order to produce labels, it is not only necessary to print the substrate, but also to cut out the individual labels. For this purpose, the printing machine includes a cutting device 52 having a nip in which labels are cut from the carrier web of the substrate and are separated from a web of grid-shaped cutting waste. This web of cutting waste is then wound up onto a reel in a wind-up unit 54, which includes a support wall 56 made of rock and a winding shaft 58.

Figure 6:
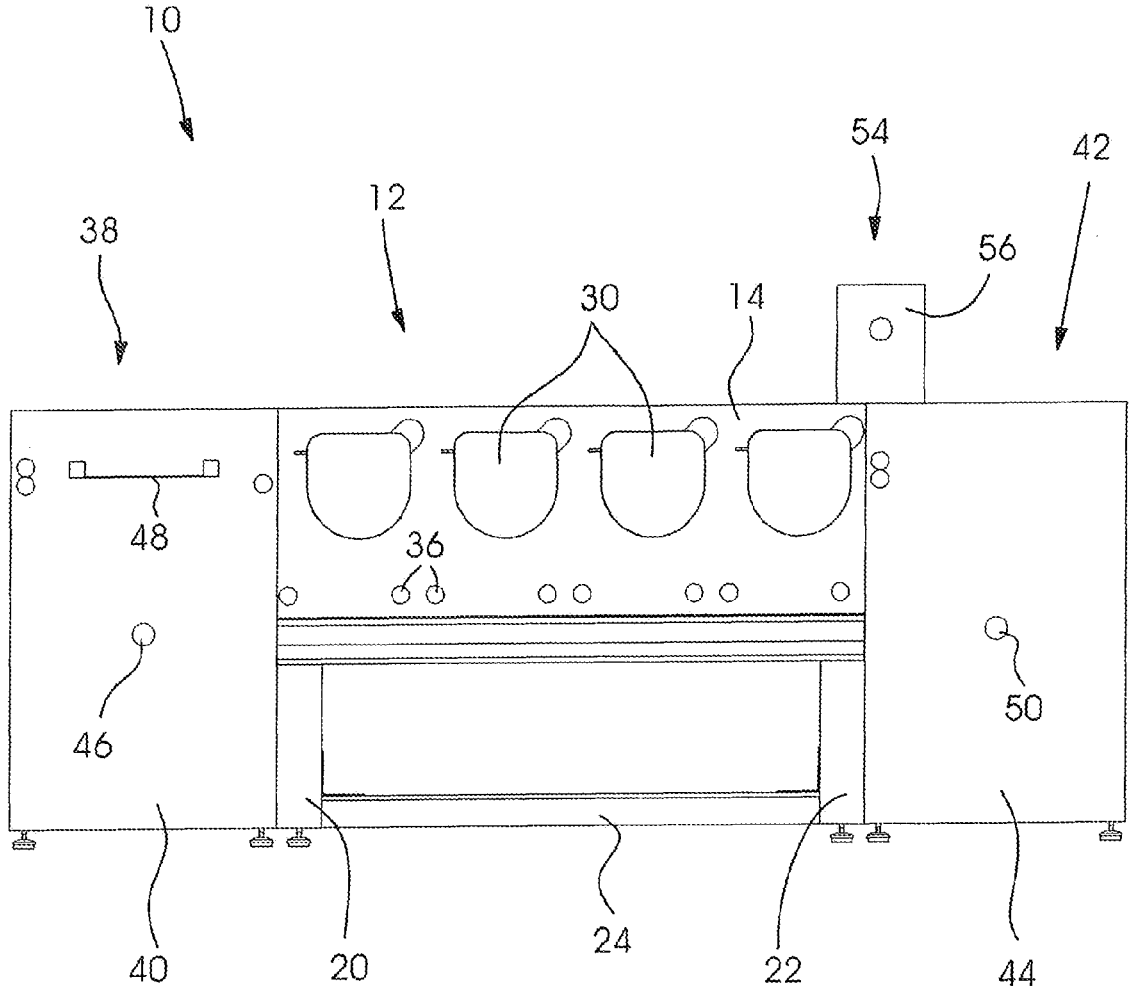
FIG. 6 is a front-elevational view of the label printing machine shown in FIG. 5.

FIG. 6 is a front view of the preferred embodiment of the printing machine 10 shown in FIG. 5, i.e. of the label printing machine with support elements made of natural rock. The two previous paragraphs of the present description provide an explanation of the reference numerals shown in the figure.

Figure 7:
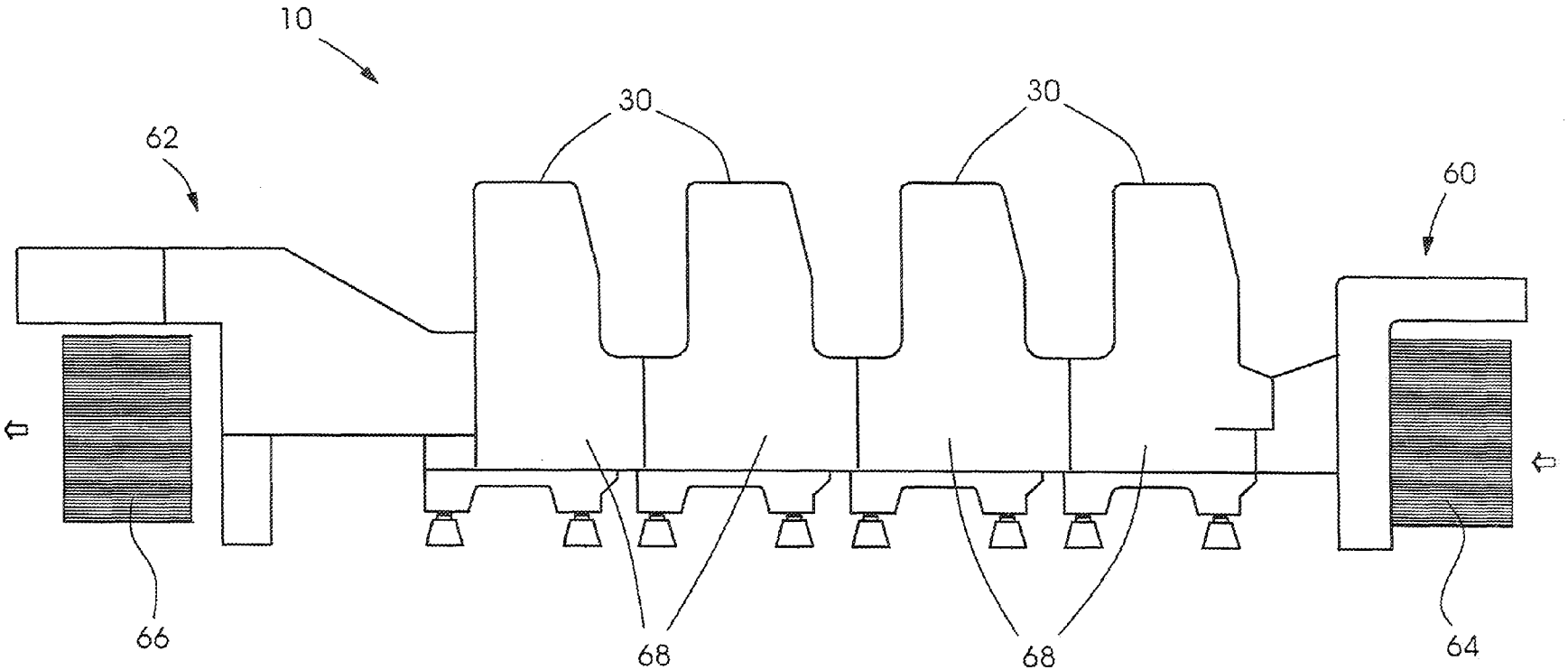
FIG. 7 is a diagrammatic, side-elevational view of an alternative embodiment of a printing machine according to the invention.

FIG. 7 diagrammatically shows a view of an alternative embodiment of a printing machine 10 according to the invention. In this embodiment, the printing machine is a sheet-fed offset printing press of in-line construction for four-color printing. The printing press has a modular construction and includes a feeder 60, four printing units 30 and a delivery 62. Individual sheets are taken from a feeder pile 64 and are fed to the printing press 10 to be processed. Once they have been dried, the sheets are deposited on a delivery pile 66 in the delivery. According to the invention, side walls 68 of the printing units 30 and corresponding components of the support structure of the printing units 30 acting as the support elements 14, are made of rock. The use of artificial rock, in particular concrete, is preferred for embodiments of sheet-processing printing presses according to the invention, because artificial rock can be given a shape suitable for an application when it is produced in a technical process. Moreover, compared to embodiments of the printing machine according to the invention as a label printing machine, a sheet-fed printing press requires a large number of bores, recesses, protrusions and the like in the side walls 68, which are easier to produce in artificial rock, in particular in concrete, than in natural rock. The support structures of the feeder 60 and the delivery 62 may also be made of rock, in particular of artificial rock, preferably of concrete. Individual functional components of the printing press, in particular the components of the printing units, however, may be made of metallic materials. In order to counteract the different thermal expansion behaviors of the materials that have been used, the printing machine according to the invention, in this embodiment a sheet-processing offset printing press, includes devices for mechanical compensation adjustment of components of the printing units, so that the desired position of the components relative to each other as a function of temperature is attained automatically and with a high degree of precision.

The invention claimed is:

1. A printing machine, comprising:

a machine support structure with a support element, said support element being entirely made of natural rock;

at least one printing unit; and a bearing element accommodating at least part of said at least one printing unit in said support element.

2. The printing machine according to claim 1, wherein said at least one printing unit includes a plurality of printing units accommodated in said support element.

3. The printing machine according to claim 1, wherein said support element is one of a plurality of support elements made of rock of said machine support structure.

4. The printing machine according to claim 1, wherein said support element is selected from the group consisting of:

a base frame;

a machine frame;

a machine foundation;

a base plate;

a base unit;

a printing unit frame;

a printing unit support;

a side part;

a side wall;

a side frame;

a support frame;

a portal support; and a connecting profile.

5. The printing machine according to claim 1, wherein said support element is made of a one-piece rock.

6. The printing machine according to claim 1, wherein said natural rock is selected from the group consisting of an eruptive rock, an intrusive rock, a dike rock, an extrusive rock and a metamorphic rock.

7. The printing machine according to claim 1, wherein said natural rock is selected from the group consisting of granite, a granite-like rock, a granite porphyry, gneiss and marble.

8. The printing machine according to claim 1, wherein said natural rock is selected from the group consisting of black granite, gabbro and impala granite.

9. The printing machine according to claim 1, wherein said support element is a composite workpiece made of rock and at least one further material.

10. The printing machine according to claim 9, wherein said further material is a plastic with a honeycomb structure.

11. The printing machine according to claim 1, wherein the printing machine is a sheet-processing printing machine.

12. The printing machine according to claim 1, wherein the printing machine is a web-processing printing machine.

13. The printing machine according to claim 12, wherein the web-processing printing machine includes a wind-up device for a printed web of printing material.

14. The printing machine according to claim 1, wherein the printing machine is a label printing machine.

15. The printing machine according to claim 1, wherein the printing machine is an offset printing press or includes at least one offset printing unit.

16. The printing machine according to claim 1, wherein said at least one printing unit includes a plurality of printing units configured to operate according to mutually different printing processes.

17. The printing machine according to claim 16, wherein said different printing processes include at least one printing process selected from the group consisting of:

flexographic printing;
gravure;
letterpress printing;
relief printing;
direct or indirect planographic printing;
lithographic printing;
offset printing;
waterless offset printing;
coldfoil stamping;
hotfoil stamping;
ink jet printing;
liquid toner printing;
screen printing; and
xerographic printing.

18. The printing machine according to claim 1, wherein the printing machine is convertible between different printing processes by removing a printing unit operating according to a first printing process in part or in total at a point of disconnection from a remainder of the printing machine, and replacing it in part or in total by a printing unit to be received at said disconnection point and operating according to a second printing process.

19. The printing machine according to claim 1, wherein said at least one printing unit includes a plurality of printing units, and the printing machine has a modular structure for said plurality of printing units.

20. The printing machine according to claim 19, wherein each of said plurality of printing units includes a support structure with at least one support element made of rock.

21. The printing machine according to claim 1, wherein said at least one printing unit includes a plurality of printing units disposed in line in a substantially horizontal direction.

22. The printing machine according to claim 1, wherein said at least one printing unit includes a plurality of printing units driven separately by individual drives.

* * * * *

UNITED STATES PATENT AND TRADEMARK OFFICE

CERTIFICATE OF CORRECTION

PATENT NO. : 7,980,176 B2
APPLICATION NO. : 11/853980
DATED : July 19, 2011
INVENTOR(S) : Dieter Bangel It is certified that error appears in the above-identified patent and that said Letters Patent is hereby corrected as shown below:

Item (73) should read as follows:

(73) Assignee: Gallus Druckmaschinen GmbH

Langgoens-Oberkleen (DE)

Signed and Sealed this
Eighteenth Day of October, 2011

David J. Kappos

David J. Kappos
*Director of the United States Patent and Trademark Office*